United States Patent [19]

Hatanaka

[11] Patent Number: 5,010,365

[45] Date of Patent: Apr. 23, 1991

[54] ELECTROPHOTOGRAPHIC APPARATUS HAVING POSITIONING MECHANISM FOR DETACHABLE PROCESS CARTRIDGE

[75] Inventor: Sunao Hatanaka, Takizawa, Japan

[73] Assignee: Alps Electric Co., Ltd., Tokyo, Japan

[21] Appl. No.: 307,863

[22] Filed: Feb. 7, 1989

[30] Foreign Application Priority Data

Mar. 31, 1988 [JP] Japan ..... 63-41844[U]

[51] Int. Cl.[5] ..... G03G 15/00

[52] U.S. Cl. ..... 355/211

[58] Field of Search ..... 355/200, 210, 211, 296, 355/301, 302

[56] References Cited

U.S. PATENT DOCUMENTS 3,966,316 6/1976 Pfeifer et al. ..... 355/200
4,598,992 8/1986 Landa et al. ..... 355/211
4,609,279 9/1986 Mitzutani .

FOREIGN PATENT DOCUMENTS 59-116675 7/1984 Japan ..... 355/211
59-184387 10/1984 Japan ..... 355/211
62-242984 10/1987 Japan ..... 355/301
1352752 4/1971 United Kingdom .

*Primary Examiner*—Joan H. Pendegrass
*Attorney, Agent, or Firm*—Guy W. Shoup; Norman R. Klivans

[57] ABSTRACT

An electrophotographic apparatus having a process cartridge for placing a photosensitive drum capable of rotating on a rotational shaft is detachably provided in a housing containing a photosensitive drum driving mechanism and having an opening formed at the top of the housing openable by a cover for detaching and attaching the process cartridge. A positioning mechanism for positioning the rotational shaft of the photosensitive drum is attached through the opening at a predetermined position and is capable of transmitting the drive of the driving mechanism. Thus, the process cartridge can be detached or attached from or to the housing elevationally with respect to the housing and the cartridge can be attached or detached while an operator stands still.

3 Claims, 3 Drawing Sheets

ELECTROPHOTOGRAPHIC APPARATUS HAVING POSITIONING MECHANISM FOR DETACHABLE PROCESS CARTRIDGE

BACKGROUND OF THE INVENTION

1. Field of the Invention

This invention relates to an electrophotographic apparatus for forming an image by an electrophotographic system in a printer, such as a laser printer, an LED printer, a liquid crystal printer, etc. used as the terminal equipment of a computer, a facsimile or the like and, more particularly, to an electrophotographic apparatus adapted for so-called "a personal use" to be easily handled.

2. Description of the Prior Art

In a conventional electrophotographic apparatus, a periodic inspection and a replacement of necessary components have been performed by a special maintenance technician except for the supply of toner.

However, as this electrophotographic apparatus is brought into personal use, a problem occurs in the necessity of periodic inspection in terms of expense and rapidity. In order to cope with the problem, a process cartridge in which a charger, a cleaner, a developing unit, a waste toner storage unit and the like are integrally associated, in addition to a photosensitive drum, in a cartridge as required is constructed and delivered in the market.

Since a general user can easily replace components in a component replacing system using the process cartridge, a special maintenance technician is not required except for an accidental trouble, which contributes to the popularization of the personal use electrophotographic apparatus.

A conventional electrophotographic apparatus using the above-described process cartridge is disclosed, for example, in Japanese Patent Laid-open No. 34545/1984 entitled "A Copying Machine". In this copying machine, as shown in FIGS. 4 and 5, an opening 3 is formed at the front wall 2 of a housing 1, and the opening 3 is openably formed by a front cover 4 supported by the bottom of the housing 1. A process cartridge 5 which can be laterally drawn from the opening 3 is arranged in the housing 1, and in the process cartridge 5 are arranged a photosensitive drum 7 rotatably provided through a rotational shaft 6, a charger 8 for uniformly applying charge to the photosensitive drum 7, a developing unit 9 for depositing toner T on an electrostatic latent image formed on the photosensitive drum 7, and a cleaner 10 for removing the remaining toner on the drum 7.

On the other hand, in the housing 1 are arranged a light source 12 for scanning an original on a contact glass 11 on the upper surface thereof, an optical system 13 for forming the electrostatic latent image based on image information of the original scanned by the light source 12, a transfer unit 14 for transferring the toner image formed on the drum 7 by the developing unit 9 to a sheet, and a fixing unit 15 for fixing the toner image transferred to the sheet to the sheet by means of heat and pressure.

However, according to the electrophotographic apparatus (copying machine) described above, the front cover 4 is opened to detach or attach the process cartridge 5. In this case, since a structure that the process cartridge 5 is horizontally drawn from the opening 3 is employed, a new process cartridge 5 must be placed on a table or on an exclusive base for placing it, and the process cartridge 5 must be detached and alternatively attached in a bent waist attitude to causing the operability to be reduced.

SUMMARY OF THE INVENTION

Accordingly, an object of this invention is to provide an electrophotographic apparatus which can eliminate the above-described disadvantages of the prior art and in which a process cartridge can be detached or attached from or to a housing elevationally with respect to the housing and the cartridge can be attached or detached while an operator stands still.

In order to achieve the above and other objects according to this invention, there is provided an electrophotographic apparatus having a process cartridge for placing at least a photosensitive drum capable of rotating at a rotational shaft as a center to be detachably provided in a housing containing a photosensitive drum driving mechanism arranged thereon comprising an opening formed at the top of said housing to be openable by a cover for detaching and attaching said process cartridge, and a positioning mechanism for positioning the rotational shaft of said photosensitive drum attached through said opening at a predetermined position capable of transmitting the drive of said driving mechanism in said housing.

According to the arrangement of the present invention described above, a new process cartridge is placed on a table or on an exclusive base for placing it, an operator can rotate the cover at the top of the housing to open the opening while he stands still, thereby to elevationally detach and attach the process cartridge through the opening. In case of attaching the cartridge, the rotational shaft of the photosensitive drum can be positively positioned at the predetermined position capable of transmitting the drive of the driving mechanism by the positioning mechanism.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

An embodiment of the present invention will be described in detail with reference to the accompanying drawings.

Figure 1:
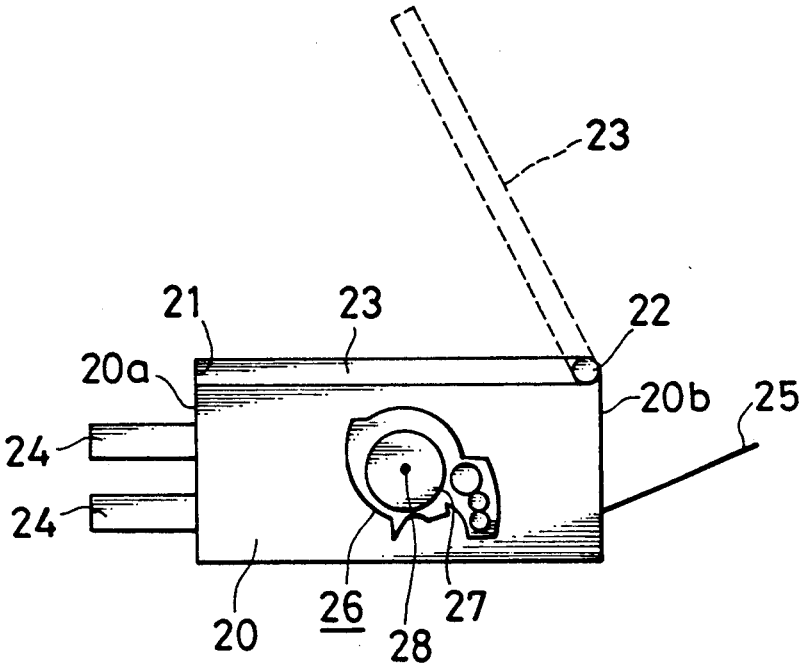
FIG. 1 is a schematic lateral sectional view of a page printer showing an embodiment of an electrophotographic apparatus according to the present invention.
Figure 3:
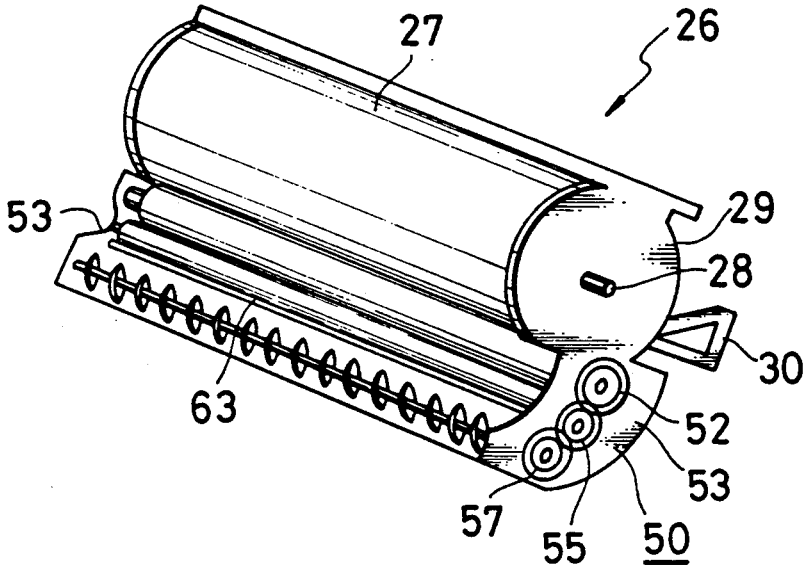
FIG. 3 is a perspective view showing the process cartridge of the page printer of FIGS. 1 and 2.
Figure 2:
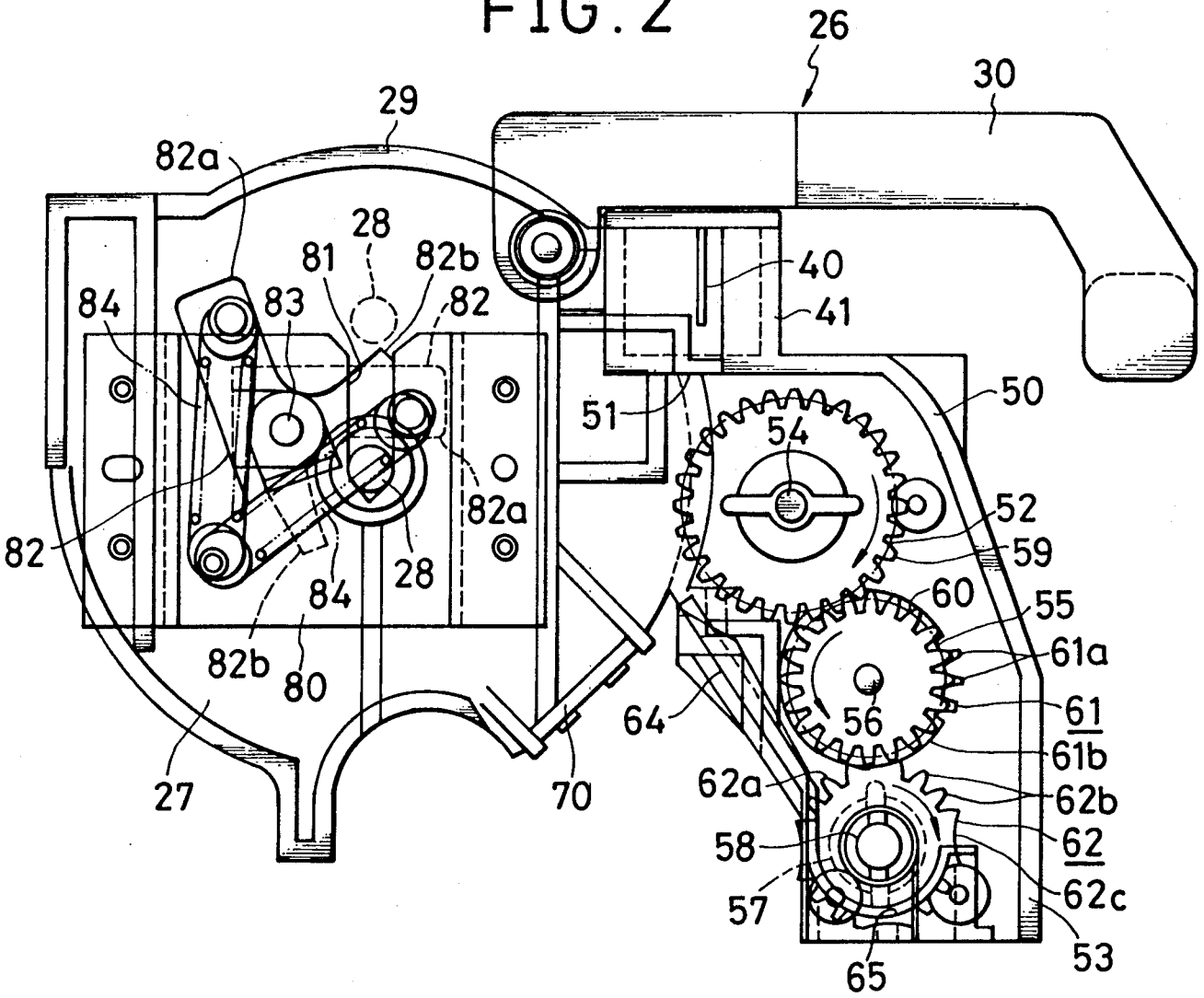
FIG. 2 is an enlarged sectional view of an essential portion of the printer of FIG. 1.
Figure 4:
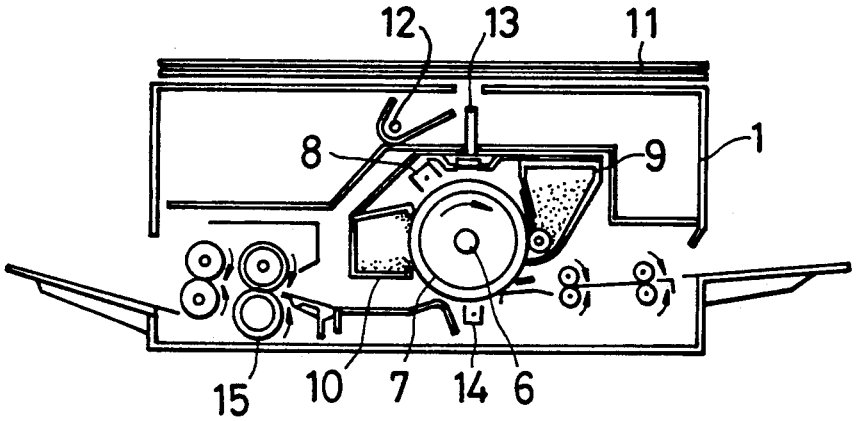
FIG. 4 (PRIOR ART)
FIGS. 4 and 5 are lateral sectional and perspective views showing a conventional electrophotographic apparatus.
Figure 5:
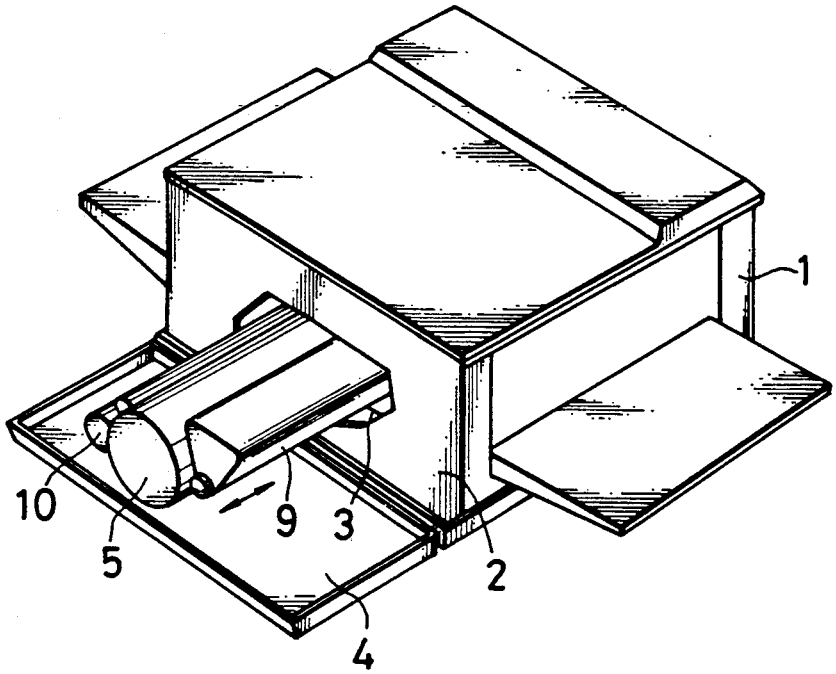
FIG. 5 (PRIOR ART)

FIGS. 1 to 3 show a page printer as an embodiment of an electrophotographic apparatus of the present invention, the page printer according to the invention comprises, as shown in FIG. 1, an opening 21 formed at the top of a housing 20. The opening 21 is openable by a cover 23 secured pivotally in elevational directions by a supporting shaft 22 supported to the end of the housing 20 and extended horizontally. A sheet supply cassette 24 is attached to one sidewall 20*a* of the housing 20, and an output sheet tray 25 is attached to the other sidewall 20*b*.

A process cartridge 26 has, as shown in detail in FIGS. 2 and 3, a horizontal cylinder 29 containing a photosensitive drum 27 rotatably contained through the rotational shaft 28 (driven by gear 28') of the photosensitive drum 27. A handle 30 for grasping the process cartridge 26 in case of detaching or attaching the process cartridge 26 from or to the housing 20 is attached to the top of the cylinder 29, and outside the cylinder 29 under the handle 30 are sequentially arranged an auxiliary charger 40 for precharging the toner remaining on the drum 27 to uniformize the charging polarity of the toner, and a cleaner 50 for recovering the remaining toner of the drum 27 in the order from above to below.

Guide plates 80, 80 disposed in parallel with each other stand in the housing 20, vertical slits 81 so opened at the upper end as to be disposed in the upper opening 21 of the housing 20 are formed at the upper ends of the guide plates 80, and both the ends of the rotational shaft 28 of the drum 27 disposed externally of the cartridge 26 are detachably engaged within the slits 81. Bell-crank-shaped holding levers 82 formed substantially in L shape are rotatably supported by a supporting shaft 83 at the bent portions of the levers to the guide plates 80, and both protrusions 82*a*, 82*b* of the levers 82 can cross the slits 81 when the lever 82 is rotated. A coiled spring 84 held in an always extended state is extended between one protrusion 82*a* of the lever 82 and the guide plate 80. The spring 84 so urges the holding lever 82 counterclockwise in the state that the other protrusion 82*b* crosses the slit 81 as designated by solid lines in FIG. 2 since the spring 84 is disposed at the left side from the shaft 83, and urges it clockwise in the state that the protrusion 82*b* crosses the slit 82 since the spring 84 is disposed at the right side from the shaft 83. It is noted that the position of the lever 82 designated by the solid lines in FIG. 2 is in the state that the rotational shaft 28 of the drum 27 is detached from the slit 81. A gear 28', engaged with a gear attached to a driving shaft, not shown, in the housing 20 is engaged with one end of the shaft 28.

The auxiliary charger 40 is so provided in a projection 41 under the handle 30 and projected to extend longitudinally of the cartridge 5 as to oppose to the drum 27.

The cleaner 50 has a cleaning roller 52 on which a number of brushes 52*a* are inserted to contact the outer periphery of the drum 27 through the opening 51 formed at the lower cylinder 29 of the charger 40, and the cleaning roller 52 is rotatably supported through a rotational shaft 54 to a pair of brackets 53, 53 protruded at both ends of the cartridge 26. A recovery roller 55 made of a magnet to contact the outer periphery of the cleaning roller 52 is rotatably supported through a rotational shaft 56 to the brackets 53, 53, and a spiral roller 57 made of a spiral blade is further rotatably supported through a rotational shaft 58 to the brackets 53, 53 under the recovery roller 55. A spur gear 59 is engaged with the shaft 54 of the roller 52 disposed externally of the one bracket 52, and the spur gear 59 is engaged with a driving gear, not shown, provided in the housing 20 and rotatably driven clockwise as designated by an arrow. A spur gear 60 engaged with the spur gear 59 is engaged with the end of the shaft 56 of the roller 55, and, when the roller 52 is rotated clockwise, it is rotatably driven in a counterclockwise direction as designated by an arrow. Further, only three intermittent gears 61, 61, . . . are connected partly to the outer periphery of the shaft 56 of the roller 55, the gears 61 in which the remainders are formed in smooth portions 61*b* are engaged therewith. The gears 62 in which four teeth 62*a* and smooth portions 62*c* are alternatively formed are engaged with the rotational shaft 58 of the roller 57, the teeth 62*a* are formed of two outer teeth 62*b*, 62*b* to be engaged with the outer teeth 61*a* of the gear 61, the smooth portion 62*c* is formed in a recess circular-arc shape, and slidably contacted with the outer teeth 61*b* of the gear 61. Accordingly, when the gear 61 is rotated counterclockwise, the gear 62 and the roller 57 are rotated at ¼ revolution clockwise as designated by an arrow.

A blade 62 is contacted along the longitudinal direction with the roller 55 to scrape off the toner on the roller 55 onto the spiral roller 57. An oblique plate 64 extended obliquely downward from the lower edge of the opening 51 is arranged under the rollers 52 and 55 to guide the toner dropped from the rollers 52, 55 toward the roller 57. A trough-shaped bottom plate 65 for covering the roller 57 is connected to the lower end of the plate 64 to be connected to a waste toner storage unit, omitted in the drawings.

In the housing 20 are sequentially arranged as necessary for a process for electrophotographing a charger, a writing member, a developing unit, a transfer unit, an electric eliminator, etc. except the drum 27, the charger 40 and the cleaner 50.

The operation of the embodiment constructed as described above is now described.

The process cartridge 26 is detached elevationally with respect to the housing 20 through the opening 21 by rotating upward to open the cover 23 attached to the top of the housing 20. More specifically, as shown in FIG. 2, in order to attach the cartridge 26 to the housing 20, the handle 30 of the cartridge 26 is grasped by a hand to raise the cartridge 26, and both the ends of the shaft 28 are moved down from the position designated by broken lines in FIG. 2 to engage with the slit 81. At this time, the holding lever 82 crosses the top of the slit 81 at its protrusion 82*a* as designated by the solid lines in FIG. 2, and the lever 82 is so urged by the coiled spring 84 as to rotate the protrusion 82*b* upward. Thus, both the ends of the shaft 28 so rotate clockwise the lever 82 as to move down the protrusion 82*b* of the lever 82 against the pressing force of the spring 84. When the spring 84 moves rightward of the supporting shaft 83 as the lever 82 rotates clockwise midway, the spring 84 reverses the urging direction of the lever 82 to urge clockwise the lever 82. Accordingly, the shaft 28 moves down by the pressing force of the spring 84 and the weight of the drum 27. When the shaft 28 arrives at the lower end of the slit 81, it elastically holds the shaft 28 at this position by the protrusion 82*a* of the lever 82 urged by the spring 84. Thus, in the state that the shaft 28 is engaged with the lower end of the slit 81 in this manner, the gear 28' engaged with one end of the shaft 28 is engaged with the gear of the driving shaft (not shown) provided in the housing 20 so that the drum 27 can be rotatably driven. At this time, the gear (not shown) engaged with the shaft 54 of the cleaning roller 52 is engaged with the gear of the other driving shaft (not shown) provided in the housing 20, and the rollers 52, 55, 57 can be rotatably driven.

On the other hand, in order to remove the process cartridge 26 from the housing 20, the cover 23 is pivotally rotated upward to open the opening 21, the shaft 28 is mounted at the lower end of the slit 81 as shown by solid lines in FIG. 2, the handle 30 is grasped in the state that it is elastically held at the protrusion 82*a* of the lever 82 urged by the spring 82 to raise the cartridge 26, both the ends of the shaft 28 are contacted with the protrusion 82*a* of the lever 82 to pull it against the pressing force of the spring 84, thereby rotating counterclockwise the lever 82. Then, when the spring 84 is moved leftward of the shaft 82 as the lever 82 is rotated, the spring 84 is again reversed in the urging direction to the lever 82, and the spring 84 urges counterclockwise the lever 82. Thus, both ends of the shaft 28 can be easily separated from the slits 81. In the state that both the ends of the shaft 28 are completely separated from the slits 81, the holding lever 82 is held at the position designated by the solid lines in FIG. 2.

Then, in the state that the cartridge 26 is mounted in the housing 20, in the conventional electrophotographic apparatus described above, the above-mentioned electrophotographic process is executed. In this process, the cleaning roller 52 and the recovery roller 55 of the process cartridge 26 are continuously rotatably driven by the rotation of the driving shaft in the housing 20 to positively remove the remaining toner on the photosensitive drum 27. However, the spiral roller 57 for conveying the recovered toner to the waste toner storage unit is connected through the intermittent gears 61, 62 to the rotational shaft 56 of the recovery roller 55 to intermittently rotate ¼ revolution with respect to one revolution of the roller 55, thereby decelerating by ¼ revolution with respect to the rotating speed of the roller 55.

According to the embodiment described above, the attachment and detaching of the process cartridge 26 at the housing 20 are executed elevationally by opening the cover 23 attached to the top of the housing 20. Therefore, the cartridge 26 can be detached and attached in a convenient attitude to provide good operability. Further, since the spiral roller 57 is decelerated by the intermittent gears 61, 62, it can be composed compactly.

The present invention is not limited to the particular embodiment. Various other changes and modifications may be made within the spirit and scope of the present invention. For example, the present invention is not applied only to a page printer, but may be applied to an electronic copying machine, a facsimile machine and the like, and a charger and/or a developing unit may be placed in the cartridge 26.

According to the present invention as described above, the process cartridge can be elevationally attached and detached to or from the housing, and the operator can attach or detach the cartridge while he stands still, thereby providing excellent operability.

What is claimed is:

1. An electrophotographic apparatus having a process cartridge including a cleaner and a photosensitive drum, said photosensitive drum rotating on a rotational shaft detachably mounted in a housing having a driving mechanism for driving said photosensitive drum arranged thereon, said apparatus comprising:

an opening formed at the top of said housing openable by a cover for inserting and removing said process cartridge; and a positioning mechanism for positioning the rotational shaft inserted through said opening at a predetermined position capable of transmitting the drive of said driving mechanism to the rotational shaft;

wherein said positioning mechanism includes means for mounting said process cartridge in said housing in a single action and for dismounting said process cartridge from said housing in a single action, and including a slit formed at a guide plate, and a bell-crank-shaped holding lever.

2. An electrophotographic apparatus according to claim 1, wherein said positioning mechanism is positioned by attaching said process cartridge elevationally.

3. An electrophotographic apparatus according to claim 1, wherein said process cartridge further includes a charger.

* * * * *